US009038621B2

(12) United States Patent
Cadima

(10) Patent No.: US 9,038,621 B2
(45) Date of Patent: May 26, 2015

(54) FLEXIBLE COUPLING OF VALVE AND CONTROL FOR A GAS COOKING APPLIANCE

(75) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 841 days.

(21) Appl. No.: 12/951,370

(22) Filed: Nov. 22, 2010

(65) Prior Publication Data

US 2012/0125318 A1 May 24, 2012

(51) Int. Cl.
*F24C 3/00* (2006.01)
*F24C 3/12* (2006.01)

(52) U.S. Cl.
CPC .. *F24C 3/126* (2013.01); *F24C 3/12* (2013.01)

(58) Field of Classification Search
CPC ..... F24C 3/12
USPC ..... 251/148; 137/599.02; 126/52, 39 E; 74/553
See application file for complete search history.

(56) References Cited

U.S. PATENT DOCUMENTS

| | | | | | |
|---|---|---|---|---|---|
| 2,025,276 | A * | 12/1935 | Drezdon | 431/280 |
| 2,117,227 | A * | 5/1938 | Stockstrom | 236/15 A |
| 2,176,076 | A * | 10/1939 | Kahn | 236/15 A |
| 2,617,404 | A * | 11/1952 | Prather | 126/39 K |
| 4,947,891 | A * | 8/1990 | Genbauffe | 137/599.17 |
| 4,984,931 | A * | 1/1991 | Struthers et al. | 403/362 |
| 5,301,653 | A * | 4/1994 | Gerdes et al. | 126/39 E |
| 5,662,465 | A * | 9/1997 | Kano | 431/12 |
| 8,136,517 | B2 * | 3/2012 | Atkinson et al. | 126/39 R |
| 2008/0017815 | A1 * | 1/2008 | Callahan et al. | 251/77 |

* cited by examiner

*Primary Examiner* — Kenneth Rinehart
*Assistant Examiner* — Gajanan M Prabhu
(74) *Attorney, Agent, or Firm* — Dority & Manning, P.A.

(57) ABSTRACT

A coupling for connection of a valve and a control element in a gas cooking appliance is provided. More particularly, the present invention provides a flexible coupling to connect between a control element manipulated by the user and a gas valve that regulates the flow of fuel to a gas burner. By coupling the control and valve by a flexible coupling, options are created for the relative placement of the valve and control, which increases the space available in the interior of the appliance and can increase the space available upon its control panel.

17 Claims, 3 Drawing Sheets

FLEXIBLE COUPLING OF VALVE AND CONTROL FOR A GAS COOKING APPLIANCE

FIELD OF THE INVENTION

The present invention relates to a gas cooking appliance that uses a flexible shaft to connect between a control element and a gas valve that regulates the flow of fuel to a gas burner.

BACKGROUND OF THE INVENTION

Most modern kitchens include at least one appliance having a cook-top or horizontal surface that includes heating elements such as gas burners for the cooking of food. These gas burners are configured with grids or other means to support cooking utensils such as pots and pans containing food. These cook-tops may be installed within cabinetry or provided as part of a free-standing appliance. One or more ovens may be associated with the cook-top.

As consumers demand more features and/or more heating elements on the cook-top, the space available on the exterior surfaces and within the interior of the appliance has become more crowded with e.g., valves, pipes, wiring, electronic features, and other components of the appliance. Consumers typically prefer multiple heating elements on the cook-top and may want additional features such as a griddle or grill. Because the space available for the installation of the cook-top may be limited due to e.g., architectural standards or customary sizes, simply increasing the size of the cook-top in order to accommodate more features is typically not practical.

For example, with a cook-top having multiple gas fueled burners positioned on its horizontal surface, the valves, piping, and manifold for supplying and controlling gas to these burners consume a generous amount of space both within the appliance and along its exterior surfaces. More particularly, each burner is usually associated with at least one valve for both turning on the burner and controlling its heat output by regulating the amount of gas flow to the burner. Each valve requires a significant amount of space because the valve must include e.g., a passage for the flow of gas, features for constricting the size of such passage, a hub for mounting the valve and containing the gas, and still other features such as a valve stem and control knob for allowing the user to selectively adjust the amount of heat by controlling the size of the gas passage.

In addition, each valve much be connected to a supply of gas, such as a gas manifold. The manifold must be large enough to supply a sufficient amount of gas at the proper pressure to fuel all of the gas burners on the appliance. Typically, the manifold is located within the appliance and provides a reservoir where gas can accumulate for supply to each of the valves during operation. The manifold is commonly located adjacent to each of the valves as well and/or directly connected to the valves. As such, the manifold also consumes a significant amount of space within the appliance. When the manifold and valves are adjacent to one another, then the amount of spacing and depth required for the manifold and valves is further increased, which can also require a larger surface on the exterior of the appliance.

Accordingly, a device that allows for improvement in the space available in a gas cooking appliance would be useful. More particularly, a device that can provide for flexibility in the positioning of the gas control valves and/or gas manifold supplying such valves would be beneficial. A device that can also allow for separation between the valve and its control element (e.g., a knob) would be also very useful in improving the space available in a gas cooking appliance.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a cooking appliance. The appliance includes a gas burner for supplying heat to a food for cooking. A valve is provided for controlling the flow of gas to the gas burner. The appliance includes a control for allowing a user of the appliance to adjust the valve to selectively control the flow of gas to the burner. The control is positioned in the appliance separately from the valve. A coupling connects the valve and the control. The coupling includes a flexible element that transmits adjustments of the control by the user to the valve so as to cause the valve to change the flow of gas to the gas burner.

In another exemplary embodiment, the present invention provides a system for controlling the gas flow in a cooking appliance. The cooking appliance has at least one gas burner. The system includes a valve for controlling the flow of gas to the gas burner. A control is provided for allowing a user of the appliance to adjust the valve so as to selectively control the flow of gas to the burner. The control is positioned in the appliance separately from the valve. A coupling connects the valve and the control. The coupling includes a flexible element that communicates adjustments of the control by the user to the valve so as to cause the valve to change the flow of gas to the gas burner due to the adjustments.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
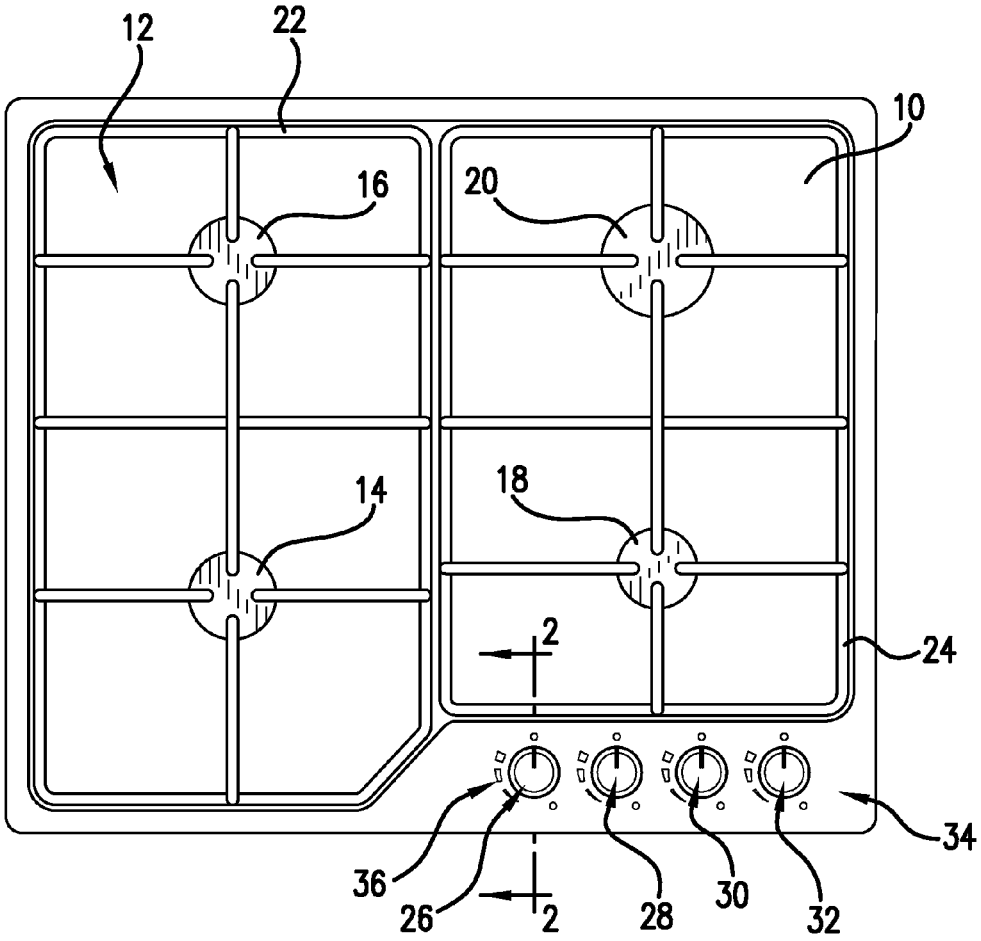
FIG. 1 provides a top view of the horizontal surface of a gas cook top appliance according to an exemplary embodiment of the present invention.

The present invention provides for the coupling of a gas valve and a control element in a gas appliance. More particularly, the present invention relates to a gas cooking appliance that uses a flexible shaft to connect between a control element and a gas valve that regulates the flow of fuel to a gas burner. By coupling the control and valve by a flexible element, an oven designer is provided with more options for placement of the valve and control, which results in a space savings both within the appliance and along the panel where the control is located. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exemplary embodiment of a cook-top appliance 10 of the present invention. Cook-top 10 could be e.g., installed into the cabinetry of a kitchen and could be associated with one or more ovens. Cook-top 10 includes a horizontal surface 12 on which a plurality of heating elements—here gas burners 14, 16, 18, and 20—are located. Burner grates or grids 22 and 24 provide support for cooking utensils placed thereon for the heating and cooking of food. Burners 14, 16, 18, and 20 are associated with controls 26, 28, 30, and 32, respectively. Controls 26, 28, 30, and 32 are each positioned on a panel 34 located on the side of cook-top 10 where the user would be positioned during cooking. Indicia 36 located at each control 26, 28, 30, and 32 help identify whether a corresponding control is turned on and, if so, to what extent.

Cook-top 10 is provided by way of example only. The present invention may be used with other cooking appliances having gas burners and associated controls. Accordingly, the present invention may be used with a cook-top having e.g., a different number and/or positioning of burners 14, 16, 18, and 20. The present invention may be used with cook-tops having controls mounted on e.g., a vertical surface facing the user. A cook-top associated with one or more ovens may be used as well. Still other variations may be used within the spirit and scope of the present invention.

Figure 2:
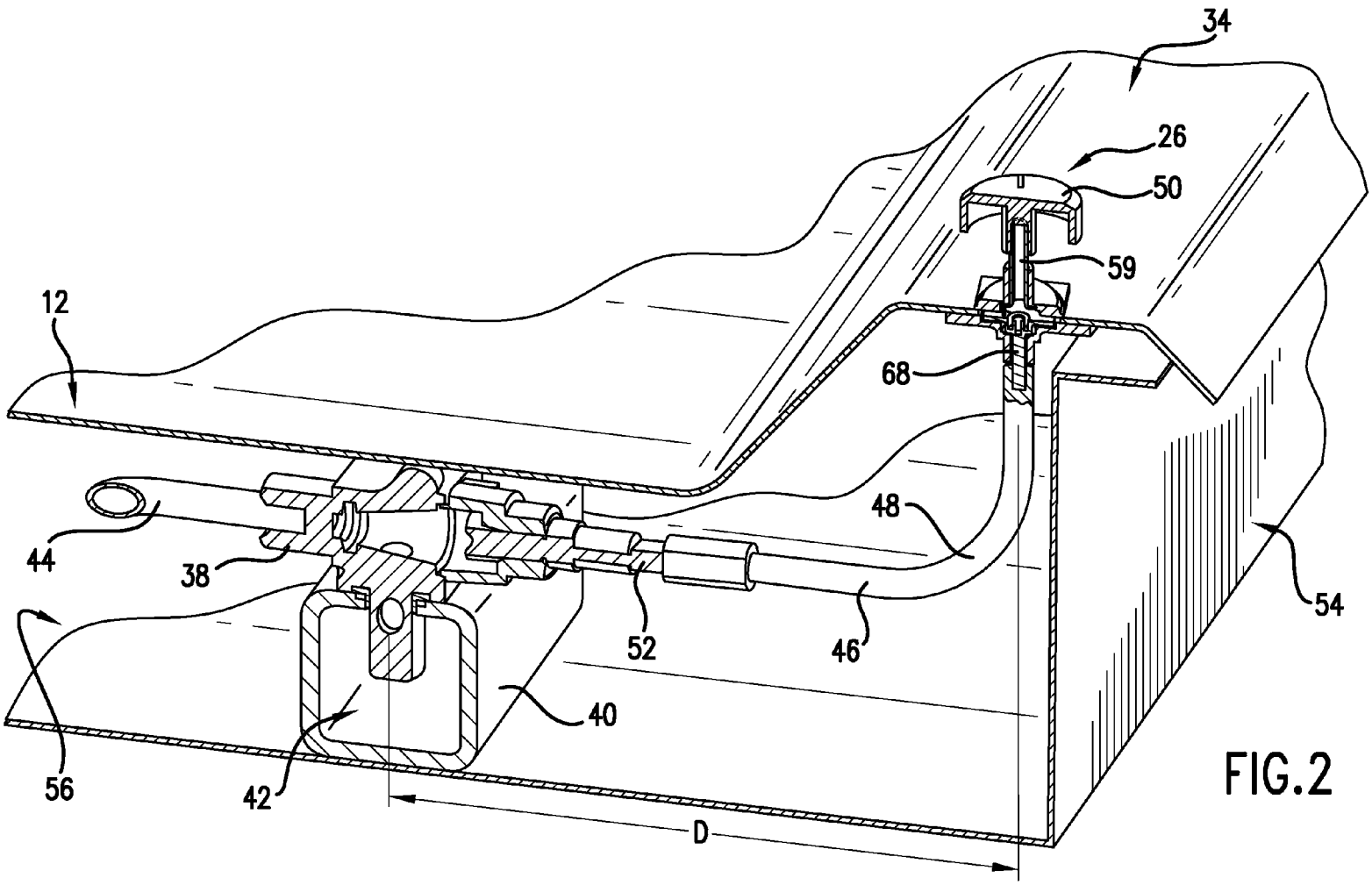
FIG. 2 provides a partial, cross-section view of the exemplary embodiment of FIG. 1 that is taken along line 2-2 of FIG. 1.

FIG. 2 provides a partial, cross-sectional view along line 2-2 of FIG. 1. As shown, control 26 is mounted on raised panel 34. Control 26 is connected or coupled to a valve 38, which in turn is connected directly to a gas manifold 40. The interior 42 of gas manifold 40 is provided with a gaseous fuel from an external supply (not shown). Gaseous fuel can accumulate in manifold 40 at a predetermined pressure for supply to valve 38. Upon opening of valve 38, gas flows from interior 42, through valve 38, and into a tube 44 that supplies the gaseous fuel to burner 14.

As shown, valve 38 is spaced apart from control 26 by a predetermined distance D. A coupling 46 connects control 26 and valve 38. More specifically, coupling 46 is a flexible element, that extends between control 26 and valve 38, even including a 90 degree bend 48 along its length. Control 26 is adjusted by rotation of handle portion or knob 50. These adjustments axe transmitted by coupling 46 to valve 38 in that rotations of knob 50 result in rotations of stem 52 of valve 38. Such rotations change the size of the gas flow passage in valve 38. Which changes the flow of gas therethrough to burner 14.

As shown, valve 38 is spaced apart from control 26 by a predetermined distance D. A coupling 46 connects control 26 and valve 38. More specifically, coupling 46 is a flexible element that extends between control 26 and valve 38, even including a 90 degree bend 48 along its length. Control 26 is adjusted by rotation of handle portion or knob 50. These adjustments are transmitted by coupling 48 to valve 38 in that rotations of knob 50 result in rotations of stem 52 of valve 38. Such rotations change the size of the gas flow passage in valve 38, which changes the flow of gas therethrough to burner 14.

Preferably, coupling 46 is constructed from e.g., a flexible metal shaft sufficient to transfer the torque from the rotation of control 26 into a rotation of stem 52 of valve 38. Such flexibility allows more options in the positioning of control 26 relative to valve 38. For example, the flexibility of coupling 46 allows it to be routed as needed within the interior space 56 created by cabinet 54 and horizontal surface 12, which can include routing around other features desired for appliance 10. In addition, the length of coupling 46 can be selected as needed such that the appliance designer has greater freedom in the relative positioning of valve 38 and control 26. More particularly, more flexibility in selecting the predetermined distance D between control 26 and valve 38 is provided.

For the embodiment of FIG. 2, where valve 38 is attached directly to gas manifold 40, the use of coupling 46 also allows the appliance designer to avoid the necessity of positioning valve 38 and/or manifold 40 directly under panel 34. This results in greater flexibility in the shape and location of panel 34 as well as a significant space savings in both the depth required below control 26 and the spacing between controls 26, 28, 30, and 32. For purposes of clarity, FIG. 2 shows the use of a coupling with control 26 only, it being understood that controls 28, 30, and 32 can also each be equipped with a respective coupling and valve.

Figure 3:
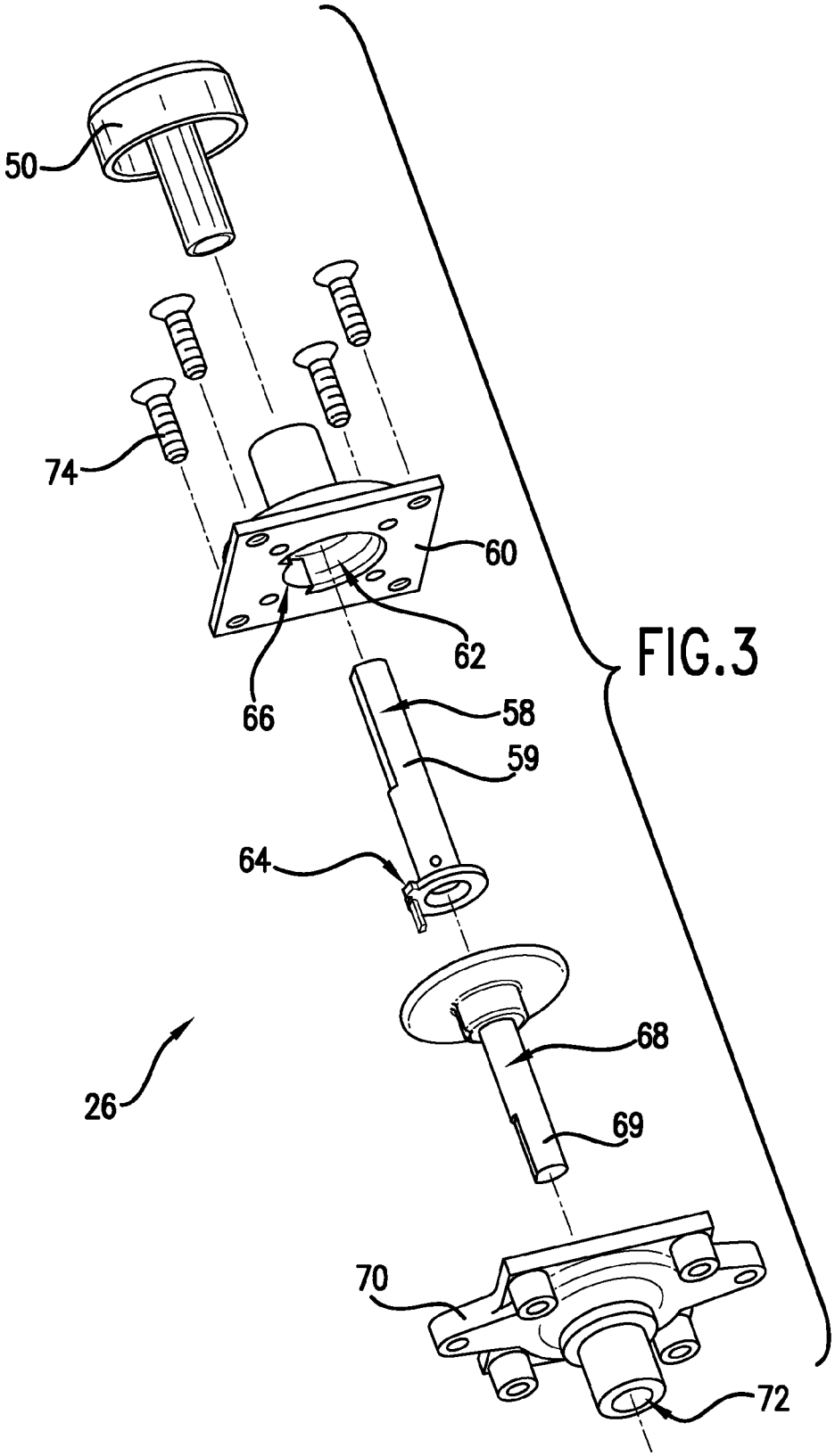
FIG. 3 is an exploded view of an exemplary embodiment of a control according to the present invention.

Controls 26, 28, 30 and 32 each include a push-to-turn functionality. In order to turn on any such control, the user must first press down on the control before it will rotate from an "off" position to an "on" position. Referring now to FIG. 3, an exploded view of control 26 is provided by way of example. More particularly, control 26 includes an upper cam 58 that is connected to knob 50 by stem 59. An upper hub 60 defines an opening 62 for the receipt of the stem 59 of upper cam 58. A locking tab 64 is formed on in upper cam 58, and is configured for receipt into a notch 66 formed at opening 62 in upper hub 60. Upon pressing down onto knob 50, tab 64 is pushed out of notch 66 allowing the user to rotate upper cam 58.

Control 26 also includes a lower cam 68 that is configured for receipt of upper cam 58. Specifically, upon pressing down knob 50, upper cam 58 engages lower cam 68 such that rotation of knob 50 rotates upper cam 58 and lower cam 68. A lower hub 70 defines an opening 72 for the receipt of a stem 69 of lower cam 68. As shown in FIGS. 2 and 3, for example, lower cam 68 is connected by stem 69 to flexible coupling 46 to transfer the rotation of knob 50 into rotation of valve 38. Although not shown, it should be understood that when needed, a gear box or other transfer mechanism could be located at the end of flexible coupling 46 connecting it to valve 38. Such gear box could be used to provide e.g., mechanical advantage in adjusting valve 38 or to provide additional flexibility in the positioning of valve 38.

A plurality of fasteners 74 are provided for connecting lower hub 70 with upper hub 60. In turn, control 26 is mounted onto panel 34 of appliance 10. Although controls 26, 28, 30, and 32 are shown on a panel 34 that is horizontal, panel 34 may also be located on a vertical face at the front of appliance 10 as will be understood using the teachings disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance, comprising:

a gas burner for supplying heat to a food for cooking;

a valve for setting a user-selected flow rate of gas to the gas burner;

a control for allowing a user of the appliance to adjust said valve to selectively change the user-selected flow rate of gas to the burner, said control positioned in the appliance separately from said valve; and a coupling that connects said valve and said control, said coupling comprising a flexible element coupled to said valve and said control to transmit adjustments of said control by the user to said valve so as to cause said valve to change the user-selected flow rate of gas to said gas burner;

wherein said control comprises:

a handle portion;

an upper cam configured to push and turn rotation by the user, said upper cam defining a locking tab; said upper cam in mechanical communication with said handle portion;

an upper hub defining an opening for the receipt of said upper cam, said upper hub also defining a notch for the receipt of said locking tab;

a lower cam configured for selective receipt of said upper cam, said lower cam connected with said flexible element; and a lower hub defining an opening for receipt of said lower cam.

2. A cooking appliance as in claim 1, wherein said flexible element comprises a flexible metal shaft.

3. A cooking appliance as in claim 1, wherein said control comprises a knob located at an exterior surface of the appliance.

4. A cooking appliance as in claim 1, said appliance further comprising a control panel, and wherein said control is positioned at said panel while said flexible element extends away from said panel and towards said valve such that said control and said valve are spaced apart a predetermined distance from each other.

5. A cooking appliance as in claim 4, further comprising a gas manifold for supplying gas to said valve, and wherein said valve is connected directly to said gas manifold.

6. A cooking appliance as in claim 1, wherein said control is positioned on a horizontal surface of the cooking appliance.

7. A cooking appliance as in claim 1, wherein said control is positioned on a vertical surface of the cooking appliance.

8. A cooking appliance as in claim 1, wherein said flexible element includes an approximately 90 degree bend along its length between said valve and said control.

9. A cooking appliance as in claim 1, further comprising a control knob, wherein said upper cam comprises a stem onto which said control knob is slidably received.

10. A cooking appliance as in claim 1, wherein said lower cam comprises a shaft connected to said flexible element.

11. A cooking appliance as in claim 1, wherein said lower hub is attached to the cooking appliance.

12. A system for controlling a gas flow in a cooking appliance, the cooking appliance having at least one gas burner, the system comprising:

a valve for setting a user-selected flow rate of gas to the gas burner;

a control for allowing a user of the appliance to adjust said valve to selectively change the user-selected flow rate of gas to the burner, said control positioned in the appliance separately from said valve; and a coupling that connects said valve and said control, said coupling comprising a flexible element coupled to said valve and said control to communicate adjustments of said control by the user to said valve so as to cause said valve to change the user-selected flow rate of gas to said gas burner due to the adjustments;

wherein said control comprises a knob;

an upper cam configured for push and turn rotation by the user, said upper cam defining a locking tab; said upper cam attached to said knob;

an upper hub defining and opening for the receipt of said upper cam, said upper hub also defining a notch for the receipt of said locking tab;

a lower cam configured for selective receipt of said upper cam, said lower cam connected with said flexible element; and a lower hub defining an opening for receipt of said lower cam.

13. A system for controlling the gas flow in a cooking appliance as in claim 12, wherein said flexible element comprises a flexible metal shaft.

14. A system for controlling the gas flow in a cooking appliance as in claim 12, wherein said control comprises a knob positioned on an exterior surface of the appliance.

15. A system for controlling the gas flow in a cooking appliance as in claim 12, wherein said upper cam further comprises a stern onto which said knob is slidably received.

16. A system for controlling the gas flow in a cooking appliance as in claim 12, wherein said lower cam further comprises a shaft connected to said flexible element.

17. A cooking appliance, comprising:

a gas burner for supplying heat to a food for cooking;

a valve for setting a user-selected flow rate of gas to the gas burner;

a coupling;

a control for allowing a user of the appliance to adjust said valve to selectively change the user-selected flow rate of gas to the burner, said control positioned in the appliance separately from said valve, said control comprising a handle portion;

an upper cam configured for push and turn rotation by the user, said upper cam defining a locking tab; said upper cam in mechanical communication with said handle portion;

an upper hub defining an opening for the receipt of said upper cam, said upper hub also defining a notch for the receipt of said locking tab;

a lower cam configured for selective receipt of said upper cam, said lower cam connected with a coupling; and a lower hub defining an opening for receipt of said lower cam;

wherein said coupling connects said valve and said control, said coupling comprising a flexible element coupled to said valve and said control to transmit adjustments of said control by the user to said valve so as to cause said valve to change the user-selected flow rate of gas to said gas burner.

* * * * *